US007037155B2

(12) United States Patent
Freeman et al.

(10) Patent No.: US 7,037,155 B2
(45) Date of Patent: May 2, 2006

(54) PERSONAL FLOTATION DEVICES

(76) Inventors: Jeffrey G. Freeman, 3155 Hwy. 563, Simsboro, LA (US) 71275; Ronald J. Madden, 852 Hunt Rd., Dubach, LA (US) 71235

( * ) Notice: Subject to any disclaimer, the term of this patent is extended or adjusted under 35 U.S.C. 154(b) by 0 days.

(21) Appl. No.: 10/627,094

(22) Filed: Jul. 25, 2003

(65) Prior Publication Data

US 2004/0203302 A1 Oct. 14, 2004

Related U.S. Application Data

(60) Provisional application No. 60/399,367, filed on Jul. 30, 2002.

(51) Int. Cl.
*B63C 9/08* (2006.01)
*B63C 9/11* (2006.01)

(52) U.S. Cl. ..... 441/106

(58) Field of Classification Search ..... 441/88–124; D21/804, 805
See application file for complete search history.

(56) References Cited

U.S. PATENT DOCUMENTS 1,064,743 A * 6/1913 Kepler ..... 441/115
1,252,842 A * 1/1918 Richardson ..... 441/116
1,295,715 A * 2/1919 Edmonds ..... 441/111
1,950,937 A * 3/1934 Brown ..... 441/110
2,331,301 A 10/1943 Brown
2,393,285 A * 1/1946 Brown ..... 441/110
2,629,118 A * 2/1953 Frieder et al. ..... 441/110
2,692,994 A * 11/1954 King et al. ..... 441/110
2,807,035 A * 9/1957 Phillips ..... 441/115
2,893,020 A * 7/1959 Miller ..... 441/116
3,449,778 A * 6/1969 Jones ..... 441/112
3,838,471 A * 10/1974 Brolli ..... 441/115
4,047,255 A * 9/1977 Kiefer ..... 441/110
4,052,762 A 10/1977 Zawislak
4,194,257 A * 3/1980 Martin et al. ..... 441/115
4,276,670 A * 7/1981 Marchello et al. ..... 441/115
4,416,641 A * 11/1983 Spinosa et al. ..... 441/94
D280,005 S 8/1985 Jones
4,689,030 A * 8/1987 McWaters ..... 441/88
4,799,908 A 1/1989 Lucius
4,871,338 A * 10/1989 Hoffman ..... 441/116
5,092,802 A 3/1992 Jones
5,152,706 A * 10/1992 Fister ..... 441/106

(Continued)

FOREIGN PATENT DOCUMENTS

JP 08230778 A * 9/1996

(Continued)

*Primary Examiner*—Ajay Vasudeva
(74) *Attorney, Agent, or Firm*—Haynes and Boone, LLP

(57) ABSTRACT

Personal flotation devices for water activities, which devices include a pair of front panels divided by a zipper for easy ingress and egress by the wearer and fitted with multiple clips for adjustment to the size of the user and attachment to other flotation devices. A pair of adjustable side connecting panels connect each front panel to a back or rear panel, typically having a clip-hinged, floating head support and an adjustable bottom connecting panel connects the bottom of the front panels to the bottom of the respective back or rear panels, extending between the legs of the user. Removable and adjustable shoulder straps may be employed between the front panels and the back or rear panel and one or more connecting elements, including a "buddy strap", may be connected to two or more of the flotation devices to join multiple swimmers or floaters. A child or adult flotation device may be strapped to an adult flotation device to accommodate children and to provide safety in rough water.

6 Claims, 4 Drawing Sheets

U.S. PATENT DOCUMENTS

| | | | | | |
|---|---|---|---|---|---|
| 5,295,765 | A | | 3/1994 | Choi | |
| 5,459,874 | A | | 10/1995 | Meredith | |
| 5,516,320 | A | | 5/1996 | LaPlant | |
| 5,766,114 | A | * | 6/1998 | Campbell | 482/55 |
| 5,778,451 | A | | 7/1998 | Rhea | |
| 5,855,497 | A | * | 1/1999 | French | 441/84 |
| 6,066,017 | A | * | 5/2000 | Max et al. | 441/98 |
| 6,231,411 | B1 | | 5/2001 | Vinay | |
| D443,910 | S | | 6/2001 | Wilbanks | |
| D444,839 | S | | 7/2001 | Wilbanks | |
| D448,060 | S | | 9/2001 | Wilbanks | |
| 6,298,487 | B1 | * | 10/2001 | Mayhew | 2/108 |
| 6,364,729 | B1 | * | 4/2002 | Khanamirian | 441/115 |
| 6,582,267 | B1 | * | 6/2003 | Steger | 441/112 |

FOREIGN PATENT DOCUMENTS

| | | | | |
|---|---|---|---|---|
| JP | 09136691 | A | * | 5/1997 |
| JP | 2001130484 | A | * | 5/2001 |
| JP | 2001233289 | A | * | 8/2001 |
| JP | 2003200887 | A | * | 7/2003 |
| JP | 2004168231 | A | * | 6/2004 |

* cited by examiner

PERSONAL FLOTATION DEVICES

CROSS-REFERENCE TO RELATED APPLICATIONS

This application claims the benefit of and incorporates by reference prior filed copending U.S. Provisional Application Ser. No. 60/399,367, filed Jul. 30, 2002.

BACKGROUND OF THE INVENTION

SUMMARY OF THE INVENTION

This invention includes new and improved, typically covered, expanded-foam personal flotation devices which are characterized by zippered front panels connected to a rear panel by adjustable side panels and having an adjustable, easily releasable, typically covered fiber (nylon or polypropylene, in non-exclusive particular) bottom panel extending from the front panels between the user's legs, to the rear panel. Further included is a connector-hinged head flotation panel for supporting the user's head, optional adjustable shoulder straps and optional connecting elements such as "buddy straps" for connecting multiple users of the flotation devices together and/or additional connecting straps for joining a child's flotation device or one or more adult flotation devices to an adult flotation device, while floating on a water body.

BRIEF DESCRIPTION OF THE DRAWINGS

The invention will be better understood by reference to the accompanying drawings, wherein.

DESCRIPTION OF THE PREFERRED EMBODIMENTS

Figure 1:
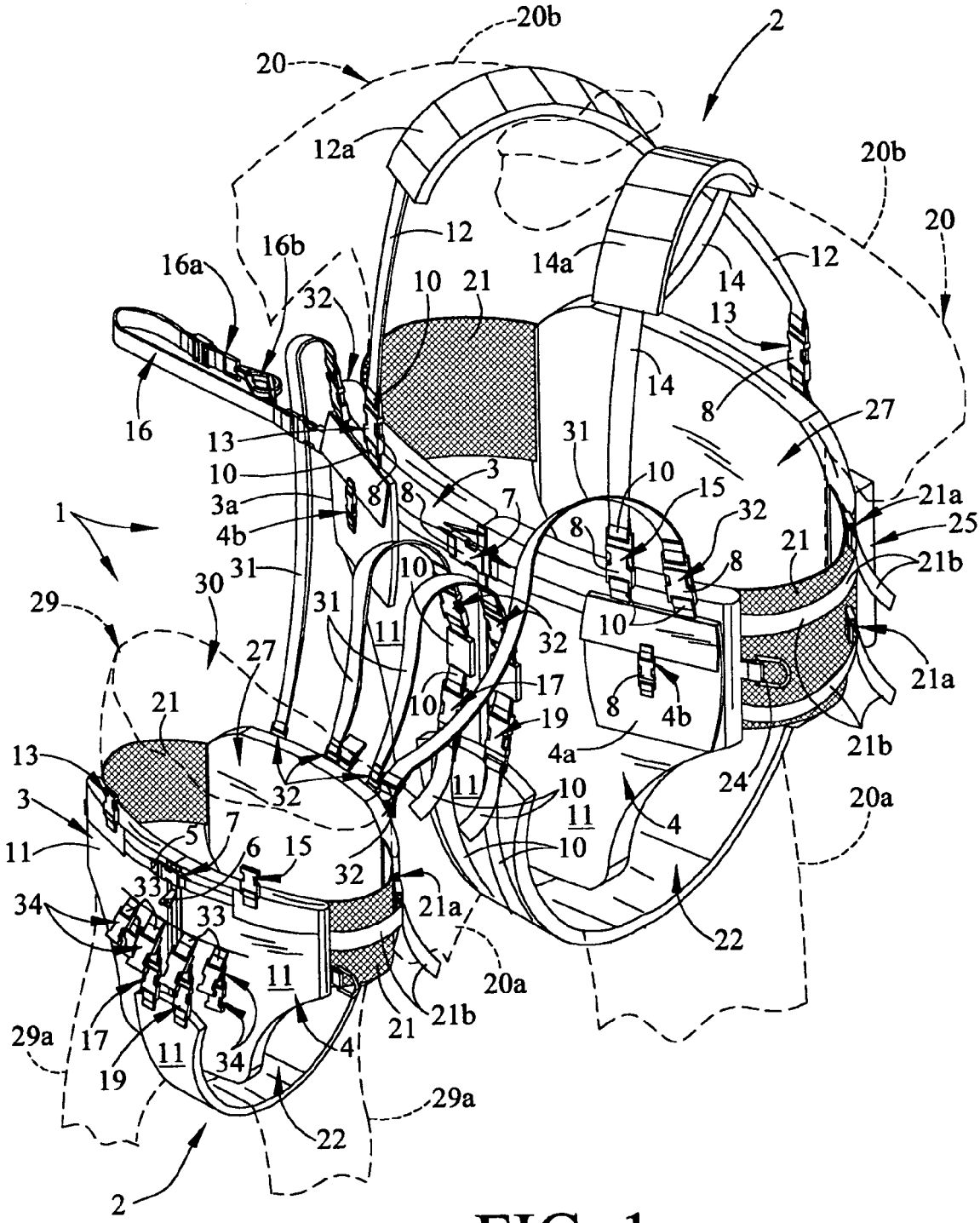
FIG. 1 is a front perspective view of a preferred embodiment of an adult flotation device (with optional shoulder straps) tethered to a child flotation device without shoulder straps.
Figure 2:
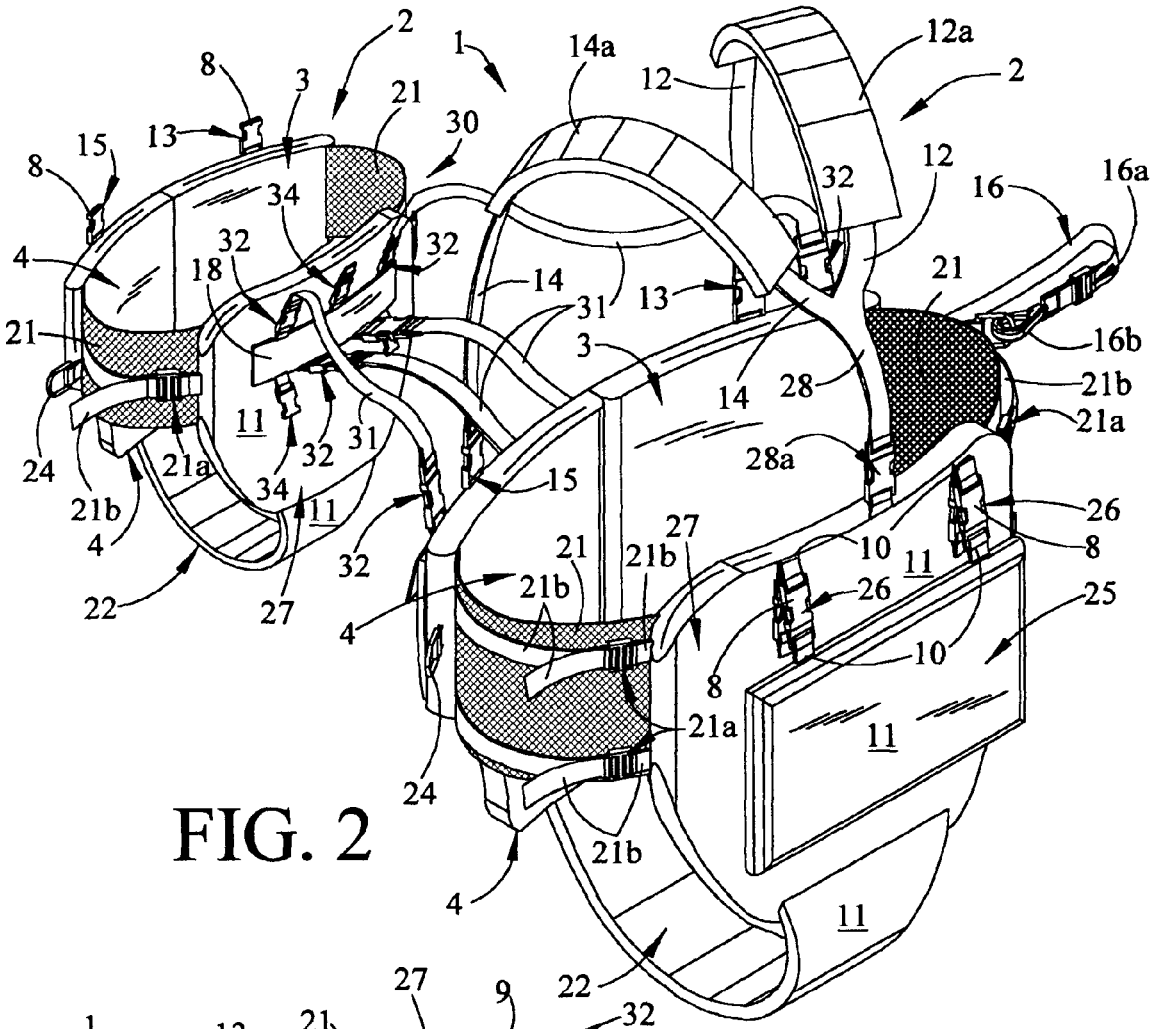
FIG. 2 is a rear perspective view of an alternative embodiment of the adult flotation device tethered to the child flotation device illustrated in FIG. 1.
Figure 3:
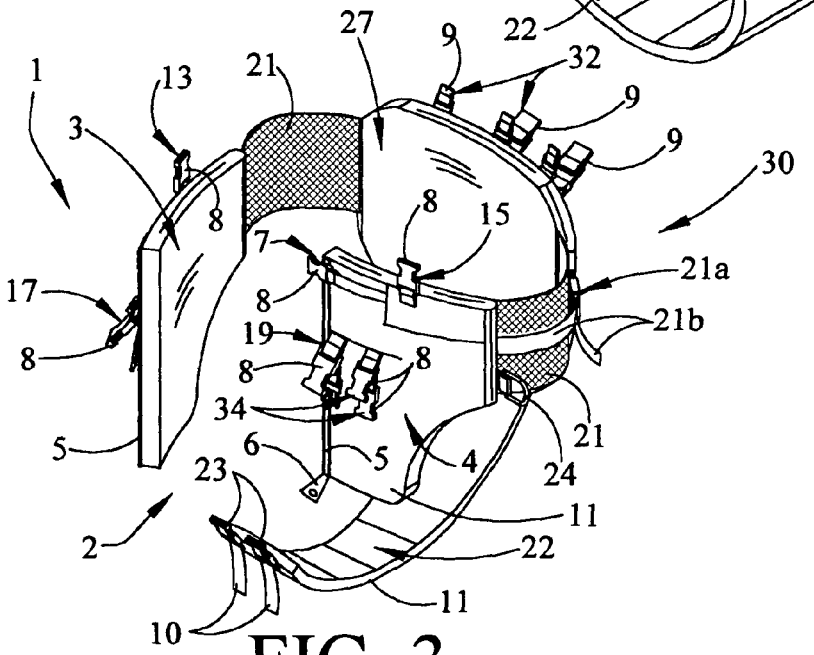
FIG. 3 is a front perspective view of the child flotation device illustrated in FIGS. 1 and 2, with the right-hand front panel partially open.
Figure 5:
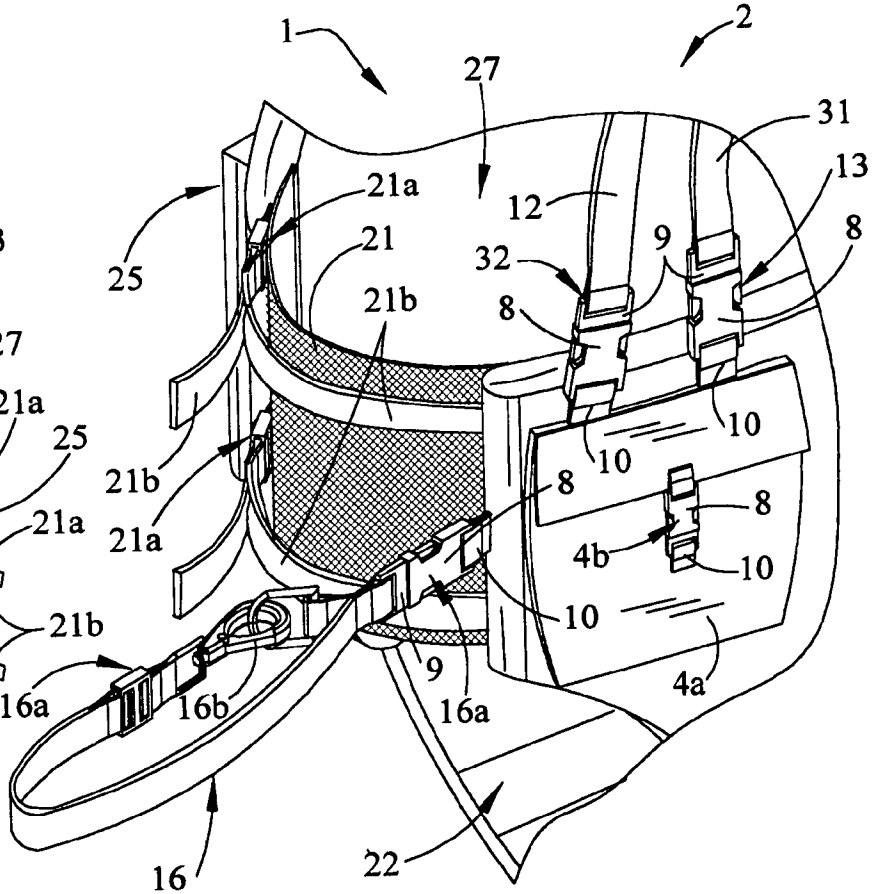
FIG. 5 is a side perspective view, partially in section, of the right frontal portion of a personal flotation device of this invention.
Figure 4:
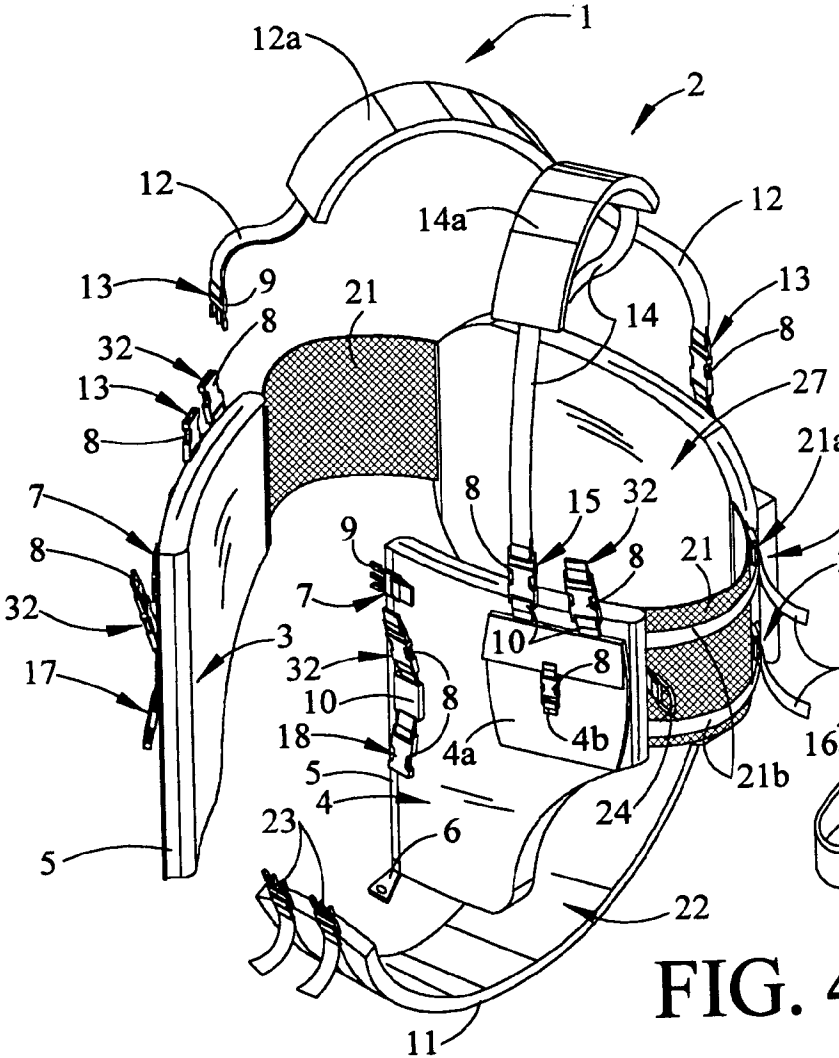
FIG. 4 is a front perspective view of an adult flotation device with the right-hand front panel partially open and optional shoulder straps in place.

Referring initially to FIGS. 1–3 of the drawings typical adult and child personal flotation devices of this invention are tethered to each other and are generally illustrated by reference numeral 1. The devices are further typically characterized by a covered, expanded foam adult flotation device 2, for an adult 20 and a child flotation device 30, on a child 29 (FIG. 1, in phantom). The adult flotation device 2 and child flotation device 30 each typically include a cover 11, which may typically be rip-stop nylon or the like, covering a right-hand front panel 3 and a left-hand front panel 4, joined by a front panel zipper 5, fitted with a zipper pull 6, as illustrated. A right-hand front panel pocket 3*a*, typically fitted with a pocket clip 4*b*, is provided on the right-hand front panel 3 of the adult flotation device 2 and a left-hand front panel pocket 4*a* may likewise be fitted with a pocket clip 4*b* and is provided on the left-hand front panel 4 of the adult flotation device 2. A front panel clip 7 spans the top adjacent edges of the right-hand front panel 3 and the left-hand front panel 4 above the front panel zipper 5 to close the mating edges of the right-hand front panel 3 and the left-hand front panel 4 on both the adult flotation device 2 and the child flotation device 30. A removable right shoulder strap 12 may optionally be provided on the right-hand front panel 3, along with right shoulder clips 13, each of which are also fitted with a female clip element 8 and a male clip element 9 (see FIG. 3), clipped together as illustrated. The female clip element 8 and the male clip element 9 of the right shoulder clip 13 are typically connected to the fabric cover 111 on the right-hand front panel 3 and to the right shoulder strap 12, respectively, by means of respective clip element straps 10. Similarly, a left shoulder strap 14 is provided on the left-hand front panel 4 and is characterized by a left shoulder clip 15, having a female clip element 8 and a male clip element 9 (FIG. 3), which are joined to the fabric cover 11 on the left-hand front panel 4 and to the left shoulder strap 14, respectively, by means of additional clip element straps 10. In the embodiment illustrated in FIG. 1, the opposite ends of the right shoulder strap 12 and left shoulder strap 14 are connected to a back panel 27 by means of an additional right shoulder clip 13 and left shoulder clip 15, respectively. Alternatively, as illustrated in FIG. 2, the right shoulder strap 12 and left shoulder strap 14 terminate at the rear of the adult flotation 2 and join at one end of a single center strap 28, secured to the back panel 27 by a center strap clip 28*a*, which is identical to the right shoulder clip 13 and left shoulder clip 15 illustrated in FIG. 1. A right torso clip 17 is provided low on the right-hand front panel 3 and includes a female clip element 8, connected to the right-hand front panel 3 by means of a clip element strap 10. Similarly, a left torso clip 19 is provided low on the left-hand front panel 4 and includes a female clip element 8, attached to the left-hand front panel 4 by means of a clip element strap 10 (FIG. 3).

Referring now to FIGS. 1–6 of the drawings the right-hand front panel 3 and left-hand front panel 4 of the adult flotation device 2 and the child flotation device 30, respectively, are connected to a corresponding back panel 27, also constructed of an expanded foam material and also typically having a suitable cover 11, by means of flexible, adjustable side connecting panels 21, typically, but not necessarily, characterized by the same material as the fabric cover 11. Each of the side connecting panels 21 is further characterized by side connecting panel clips 21*a*, each having a female clip element 8 and a male clip element (not illustrated), attached to the respective side connecting panels 21 by side connecting panel clip straps 21*b*, for adjusting the length of the respective side connecting panels 21.

As further illustrated in FIGS. 1–6 a bottom connecting panel 22, typically constructed of an expanded foam material and typically having a cover 11, extends in both the adult flotation device 2 and the child flotation device 30, from the right-hand front panel 3 and left-hand front panel 4, between a wearer or user's adult legs 20*a* and the child legs 29*a*, respectively, (FIG. 1), to the corresponding back panel 27. The bottom connecting panel 22 is typically fitted with a pair of bottom connecting panel male clip elements 23 (FIGS. 3 and 4), connected to the bottom connecting panel 22 by means of clip element straps 10, respectively. The two corresponding female clip elements 8 are included in the right torso clip 17 and the left torso clip 19, respectively, and are removably secured to the pair of bottom connecting panel male clip elements 23, respectively, to position the bottom connecting panel 21 between the adult legs 20*a* of an adult wearer 20 and the child legs 29*a* of a child 29, respectively, in functional position. In a preferred embodiment of the invention the opposite end of the bottom connecting panel 22 is either removably connected, sewn or otherwise fixed to the back panel 27, as illustrated.

Figure 6:
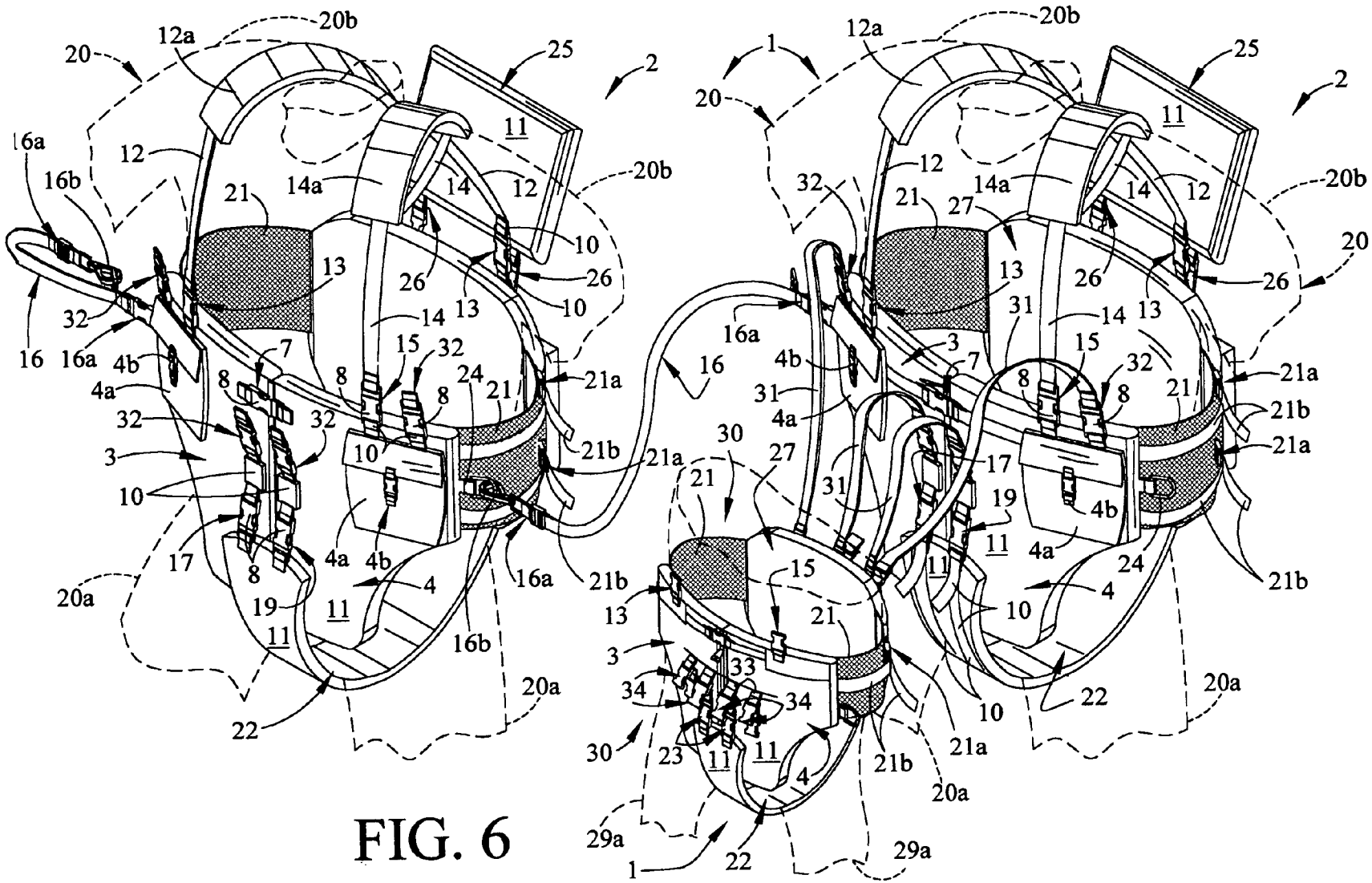
FIG. 6 is a front perspective view of a pair of adult flotation devices tethered together and a child flotation device tethered to one of the adult flotation devices.

Referring to FIGS. 2 and 6 of the drawings, a head support panel 25, constructed of an expanded foam material and typically having a cover 11, is provided for supporting the head of a user when the adult flotation device or devices 2 and child flotation device 30 are in place and during flotation, to facilitate resting an adult 20 and child 29 in a comfortable position while floating, with the head resting rearwardly on the buoyant head support panel 25. In a preferred embodiment of the invention the head support panel 25 is secured to the adult flotation device 2 and the child flotation device 30, respectively, by means of a pair of detachable hinge clips 26 and respective clip element straps 10, such that the head support is conveniently positioned by gravity alongside the back panel 27 when the user is not in the water. However, the head support panel 25 quickly and easily floats upwardly from a position at the non-floating back panel 27 (FIG. 2) to a floating configuration behind the user's head (FIG. 6), by means of the hinge clips 26 and clip element straps 10, to a head-supporting position, without the need for adjustment by the user when the user enters the water in a floating configuration.

Referring again to FIGS. 1, 2 and 6 of the drawings, as described above, the child flotation device 30 is typically designed in essentially the same configuration and has the same components, but typically without the right-hand front panel pocket 3*a* and the left-hand front panel pocket 4*a*, as the adult flotation device 2. Furthermore, the child flotation device 30 may be connected to the adult flotation device 2 by means of connecting straps 31 of selected length and construction, each fitted with connecting clips 32, typically designed in the same manner as the connecting clips described heretofore with respect to the adult flotation device 2. Accordingly, the connecting clips 32 each typically include a female clip element 8 and a male clip element 9 connected to the child flotation device 30 and the connecting straps 31, respectively, by means of respective clip element straps 10. Consequently, it will be appreciated that the child flotation device 30 can either be clipped directly and closely to the adult flotation device 2 using the connecting straps 31 by selectively taking up the slack in the connecting straps 31 at the connecting clips 32, or it may be connected to the adult flotation device 2 using the "buddy strap" 16 (FIGS. 4–6), by clipping the free end of the "buddy strap" 16 to a connecting ring 24 on the adjacent adult flotation device 2 or child flotation device 30 using the buddy strap clip 16*a* and buddy strap snap 16*b*. As in the case of the adult flotation device 2, the child flotation device 30 is characterized by adjustable, flexible side connecting panels 21 and an adjustable bottom connecting panel 22 that join a back panel 27 to a right-hand front panel 3 and left-hand front panel 4. Furthermore, a front panel clip 7, having a female clip element 8 and a male clip element 9 (illustrated in FIG. 4) attached to the right-hand front panel 3 and left-hand front panel 4, respectively, by clip element straps 10, join the abutting top edges of the right-hand panel 3 and the left-hand panel 4. A front panel zipper 5 and a zipper pull 6 may also be provided on the right-hand front panel and the left-hand front panel of the child flotation device 30, for easy ingress and egress of a user, as illustrated in FIG. 3. Auxiliary clips 34 may also be attached to the child flotation device 30 by means of auxiliary clip straps 33, as illustrated in FIG. 1, for additional strap-securing configurations between the adult flotation device 2 and the child flotation device 30.

It will be appreciated by those skilled in the art that the respective panels, elements and components of the personal flotation devices 1 of this invention, including the right-hand front panel 3, left-hand front panel 4, back panel 27, head support panel 25 and the bottom connecting panel 22 of the adult flotation device 2 and the child flotation device 30, are each constructed of a closed-cell, buoyant material such as expanded polyurethane foam in non-exclusive particular, and are characterized by convenience, flexibility, safety and utility, in that the adult flotation device 2 and the child flotation device 30 are designed to comfortably and safely accommodate adults and children, respectively, of various size and weight, during extended periods of floating. This accommodation is made simple by the provision of the adjustable, wide side connecting panels 21 and the adjustable, soft bottom connecting panel 22, for easy adjustment, comfort and security purposes. The bottom connecting panel 22 adds support for the user or wearer in the water and prevents the adult flotation device 2 and the child flotation device 30 from "riding up" on the torso of the user or wearer while floating, as well as furnishing additional buoyancy to the personal flotation devices 1. The wide, adjustable side connecting panels 21 serve to tighten the adult flotation device 2 securely, yet comfortably, around the chest and under the arms of the user for optimum security and comfort while floating. Moreover, the floating head support panel 25, attached to the back panel 27, is designed to automatically float beneath the head of the user or wearer to facilitate a comfortable supporting of the head of the user or wearer during flotation, without significant effort. The optional right shoulder strap 12 and left shoulder strap 14 may also be provided with a right shoulder strap pad 12*a* and a left shoulder strap pad 14*a*, to pad the shoulders 20*b* of a user or wearer, as illustrated in the drawings.

In a most preferred embodiment of the invention the respective flotation panels of the adult flotation device 2 and the child flotation device 30 of the personal flotation devices 1 are each constructed of the buoyant expanded foam material polyurethane or the equivalent, covered by a suitable cover 11, which may include such materials as rip-stop nylon fabric or the like, which material is sufficiently strong to attach the respective clip element straps 10 and secure the corresponding clips in place. However, it will be appreciated by those skilled in the art that the respective clip element straps 10 may also be attached directly to the expanded polyurethane foam by gluing or other bonding techniques known to those skilled in the art, without using the fabric cover 11. The polyurethane or equivalent expanded foam material used to construct the personal flotation devices 1 may be of any selected thickness and type sufficient to support and float an adult and a child, respectively, in the adult flotation device 2 and the child flotation device 30, with the user's head well above water and comfortably located on the head support panel 25. Furthermore, the respective female clip elements 8 and male clip elements 9 may be interchanged and reversed in the respective connecting positions illustrated in the drawings when connected by the corresponding clip element straps 10, as desired during construction of the personal flotation devices 1.

While the preferred embodiments of the invention have been described above, it will be recognized and understood that various modifications may be made in the invention and the appended claims are intended to cover all such modifications which may fall within the scope and spirit of the invention.

What is claimed is:

1. A flotation device for supporting a user in the water, comprising a pair of buoyant front panels; a closure connecting said front panels; a pair of side connecting panels extending from said front panels, respectively, for disposition beneath the arms of the user; a buoyant back panel connected to said side connecting panels; a buoyant bottom connecting panel extending from said front panels to said back panel for disposition between the user's legs and floating the user in the water wherein said front panels, said back panel and said bottom connecting panel are constructed of a buoyant expanded foam material and comprising a flexible cover enclosing said buoyant expanded foam material of said front panel, said back panel and said bottom connecting panel;

(a) a buoyant head support panel hingedly affixed to said back panel for floating disposition beneath the user's head and supporting the user's head above the water and wherein said head support panel is constructed of an expanded foam material and comprising a flexible cover enclosing said buoyant expanded foam material of said heed support panel; and (b) a pair of shoulder straps extending from said front panels and a connecting strap connected to said shoulder straps and said back panel for positioning said shoulder straps over the shoulders of the user.

2. The flotation device of claim 1 further comprising at least one tether connected to said flotation device for connecting said flotation device to a second flotation device.

3. The flotation device of claim 1 further comprising at least one connecting clip provided on each of said front panels for clipping said flotation device to a second flotation device.

4. The flotation device of claim 1 wherein one end of said bottom connecting panel is attached to said back panel and comprising a pair of torso clips provided on said front panels, respectively, and a pair of companion bottom connecting panel clips attached to the opposite end of said bottom connecting panel from said one end, for selectively engaging said torso clips, respectively, and removably securing said bottom connecting panel to said front panels, respectively, and said bottom connecting panel between the legs of the user.

5. A flotation device for supporting a user in the water, comprising a pair of buoyant front panels; a closure connecting said front panels; a pair of side connecting panels extending from said front panels, respectively, for disposition beneath the arms of the user; a buoyant back panel connected to said side connecting panels; a buoyant bottom connecting panel extending from said front panels to said back panel for disposition between the user's legs and floating the user in the water;

at least one tether connected to said flotation device for connecting said flotation device to a second flotation device;

(a) a buoyant head support panel hingedly attached directly to said back panel for floating disposition beneath the user's head and supporting the user's head above the water and wherein said head support panel is constructed of a buoyant expanded foam material and comprising a flexible cover enclosing said buoyant expanded foam material of said head support; and (b) a pair of shoulder straps extending from said front panels and a connecting strap connected to said shoulder straps and said back panel for positioning said shoulder straps over the shoulders of the user.

6. The flotation device of claim 5 wherein one end of said bottom connecting panel is attached to said back panel and comprising a pair of torso clips provided on said front panels, respectively, and a pair of companion bottom connecting panel clips attached to the opposite end of said bottom connecting panel from said one end, for selectively engaging said torso clips, respectively, and removably securing said bottom connecting panel to said front panels, respectively, and said bottom connecting panel between the legs of the user.

* * * * *